United States Patent [19]

Ishler et al.

[11] 4,392,076

[45] Jul. 5, 1983

[54] ATTACHMENT OF BASE TO LAMP UNIT

[75] Inventors: William E. Ishler, Lyndhurst; William B. Weber, Willoughby Hills; Livio L. Giudici, Novelty, all of Ohio

[73] Assignee: General Electric Company, Schenectady, N.Y.

[21] Appl. No.: 213,388

[22] Filed: Dec. 5, 1980

[51] Int. Cl.[3] ..... H01J 5/48; H01J 5/50

[52] U.S. Cl. ..... 313/318; 313/315; 339/83; 339/91 L; 339/54

[58] Field of Search ..... 313/318, 315, 493; 339/83, 84, 91 L, 54

[56] References Cited

U.S. PATENT DOCUMENTS

| | | | |
|---|---|---|---|
| 2,134,472 | 10/1938 | Criger et al. | 313/318 |
| 2,406,271 | 8/1946 | Van Horn | 313/318 |
| 3,253,179 | 5/1966 | Edwards et al. | 313/318 |
| 3,959,684 | 5/1976 | Anderson et al. | 313/318 |

*Primary Examiner*—Saxfield Chatmon, Jr.

*Attorney, Agent, or Firm*—Norman C. Fulmer; Philip L. Schlamp; Fred Jacob

[57] ABSTRACT

A lamp unit having a housing containing a ballast and provided with a screw base. The base fits over an end of the housing and is attached thereto by a low-cost resin material which, in cooperation with shaped contours on the housing and the base, mechanically locks these parts together.

6 Claims, 9 Drawing Figures

Fig. 1
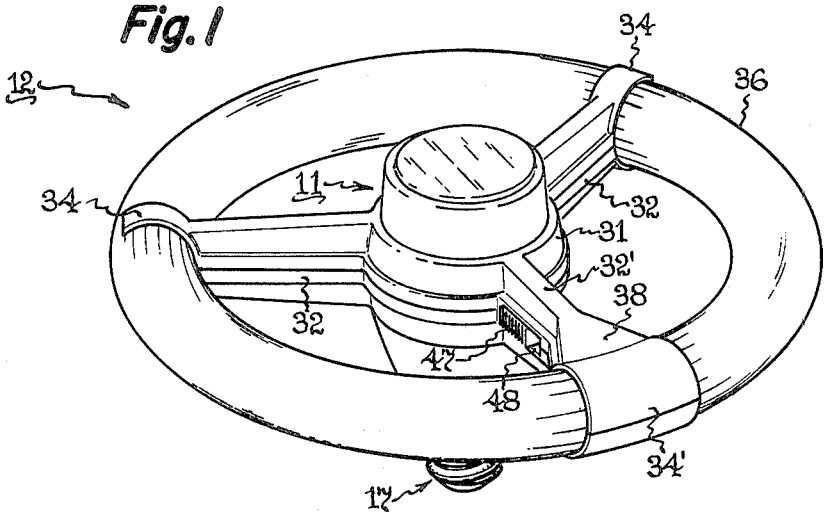
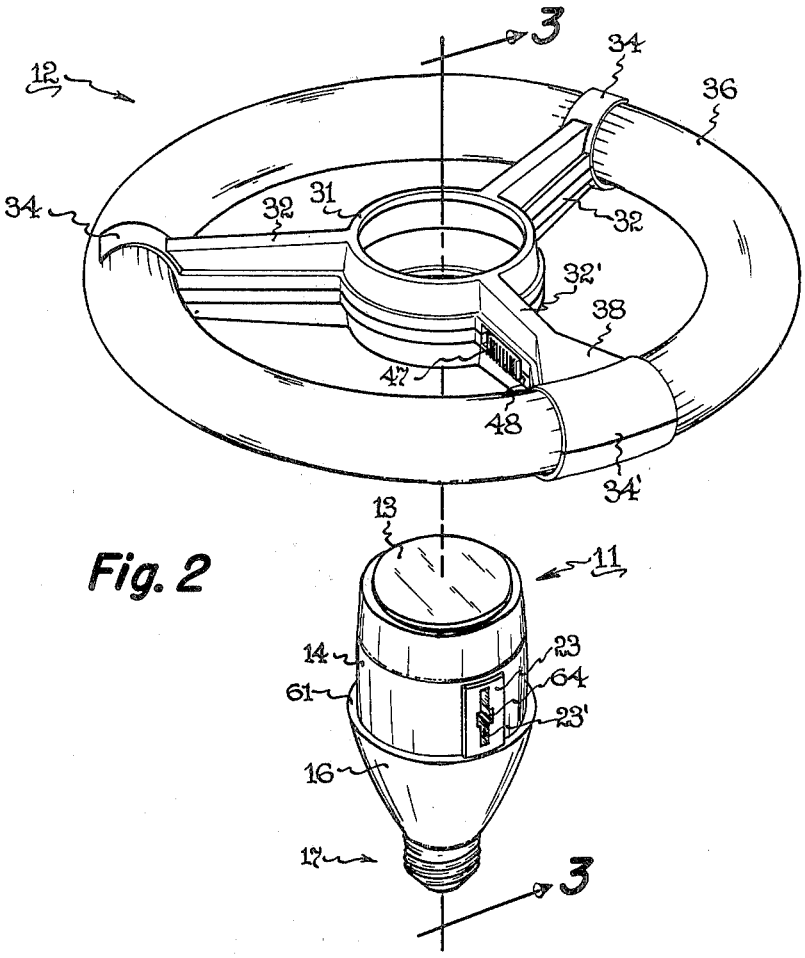
Fig. 2

Fig. 3a
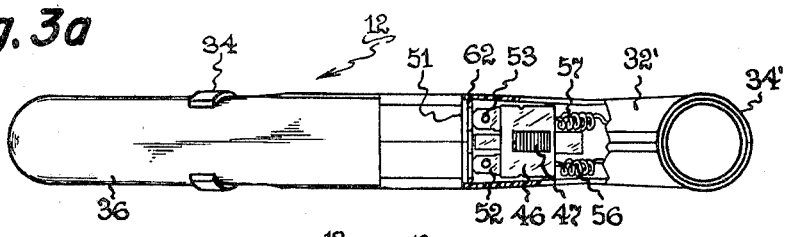
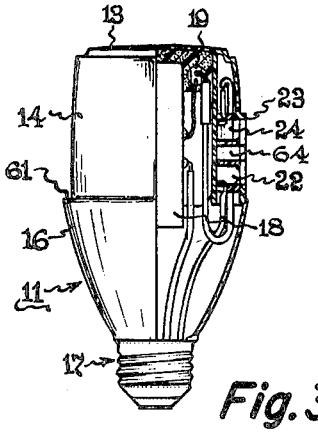
Fig. 3b
Fig. 4
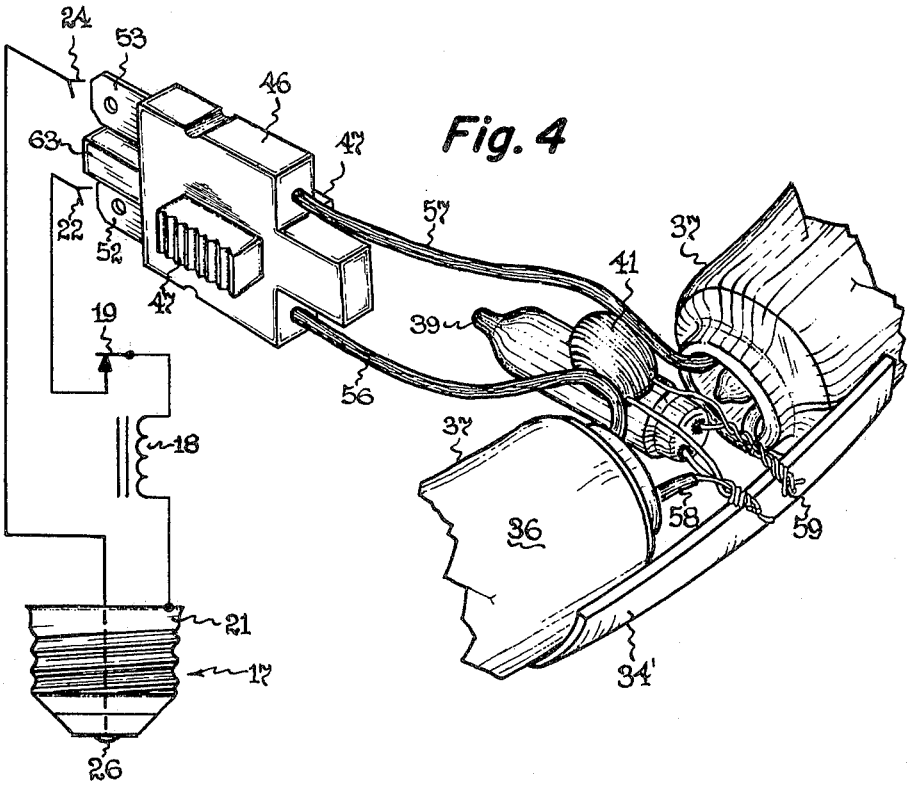

ATTACHMENT OF BASE TO LAMP UNIT

CROSS-REFERENCES TO RELATED APPLICATIONS

Ser. No. 47,986, now U.S. Pat. No. 4,258,287, Frederick Hetzel, "Circular Fluorescent Lamp Unit," filed June 13, 1979 and assigned the same as this invention.

Ser. No. 47,988, now U.S. Pat. No. 4,316,120, Ronald N. Cotman and Gustino J. Lanese, "Circular Fluorescent Lamp Unit," filed June 13, 1979 and assigned the same as this invention.

Ser. No. 47,985, now U.S. Pat. No. 4,278,911, Rudolph Metoff, "Circular Fluorescent Lamp Unit", filed June 13, 1979 and assigned the same as this invention.

Ser. No. 944,650, now U.S. Pat. No. 4,244,013 Joseph P. Wotowiec, "Circular Fluorescent Light Unit", filed Sept. 21, 1978 and assigned the same as this invention.

BACKGROUND OF THE INVENTION

The invention is in the field of lamp units, such as screw-in units having a screw base attached to a housing which may contain a ballast, such as a reactor type or an electronic circuit type, connected to a lamp such as a fluorescent type or arc type. The invention is particularly directed to the attachment of the base to the housing.

Various ways have been used, and proposed, for attaching a screw base to a light bulb or to a housing of a lamp unit, such as adhesively cementing or gluing these parts together, or attaching them together with fastening devices such as screws or staples, or by crimping the parts together. For example, U.S. Pat. Nos. 3,953,761—Lo Giudice and 2,421,571—Leyshon disclose cementing a base to a lamp unit with adhesive material, and the latter patent also discloses crimping the base to the lamp unit. U.S. Pat. Nos. 2,817,004—Baumgartner and 4,161,020—Miller disclose the use of screws for attaching a base to a lamp unit, and U.S. Pat. No. 2,525,022—Dupuy discloses a twist-lock attachment of a base to a lamp unit. All of these methods incur an amount of cost for materials and labor.

SUMMARY OF THE INVENTION

Objects of the invention are to provide a low-cost, and mechanically secure, attachment of a base to a lamp unit.

The invention comprises, briefly and in a preferred embodiment, a lamp unit which includes a housing member preferably of plastic, and a base positioned over an end region of the housing member and mechanically attached thereto by a resin material within the base and housing end region which mechanically locks onto shaped contours of the base and end region of the housing. Thus, the resin can be a low-cost non-adhesive material, applied in liquid or paste form and then hardened. The shaped contours of the base and housing can be in the form of notches, depressions, or dimples, and shelves or other projections.

BRIEF DESCRIPTION OF THE DRAWING

FIG. 1 is a top perspective view of a preferred embodiment of invention.

FIG. 2 is a view similar to FIG. 1, but with the circular lamp assembly separated from the central hub.

FIG. 3*a* is a side view of the circular lamp assembly, shown partly broken away to show interior contruction.

FIG. 3*b* is a side view of the central hub unit, partly broken away to show the interior construction.

FIG. 4 is a perspective view of a portion of the circular lamp assembly, along with a schematic diagram of the contents of the central hub.

DESCRIPTION OF THE PREFERRED EMBODIMENT

Figure 5:
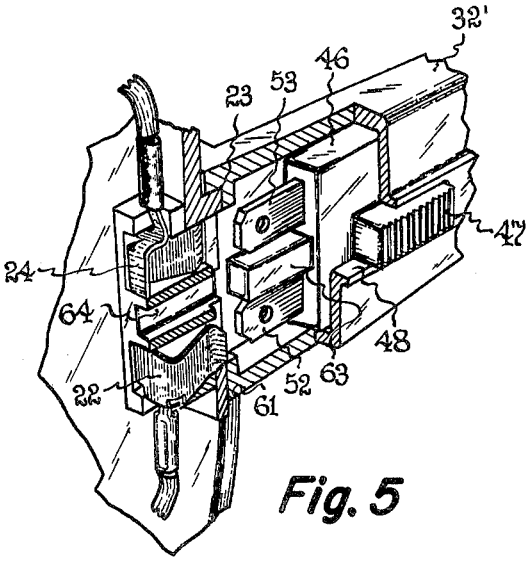
FIGS. 5 and 6 are broken away perspective views of the lamp unit, showing its slide connector in disengaged position and in engaged position, respectively.

The lamp unit comprises a central hub unit 11 and a circular lamp assembly 12 which is replacable on the hub 11. The hub 11 comprises a plastic housing 13 having a cylindrical portion 14 and a tapered section 16 at the small end to which is attached, by means in accordance with the invention as described subsequently, a threaded screw base 17. As shown in FIGS. 3*b* and 4, a ballast reactor 18 and thermal circuit breaker 19 are contained within the housing 13 and are electrically connected in series between the threaded base shell 21 and an electrical contact 22 of a raised socket 23 which projects from the side of the cylindrical portion 14 of the hub 11. The thermal circuit breaker 19 is positioned adjacent to the ballast reactor 18 and is designed to open the electrical circuit in the event of over heating of the ballast reactor 18. A second socket contact 24 is electrically connected to the button terminal 26 of the threaded base 17. The two socket contacts 22 and 24 are aligned parallel to the axis of the hub 11 and are recessed in a narrow slot 23' for electrical safety. The electrical wiring connections to the base shell 21 and button terminal 26 can be interposed, and the thermal circuit breaker 19 can be located elsewhere in the wiring within the hub 11 if desired.

The circular lamp assembly 12 comprises a sleeve ring 31 which removably slides over and surrounds the cylindrical portion 14 of the hub 11. A plurality of spokes 32 extend outwardly from the sleeve ring 31 in a symmetrical manner, and terminate with clamp arms 34 which may fully or partially surround a circular lamp or light bulb 36 and hold it in a coaxial relationship with respect to the sleeve ring 31. The assembly of the sleeve ring 31, spokes 32 and clamp arms 34 may comprise two substantially similar upper and lower plastic parts which are assembled together with their clamp arms 34 positioned against the upper and lower sides of the circular lamp 36, and may be fastened together by means of tight fitting fastening tabs, or cement. One of the spokes 32' is provided with an enlarged pair of clamp arms 34' so as to also function as a connector housing which fits around and conceals the end regions 37 of the lamp 36, and associated wiring thereof, as will be described and which is best shown in FIG. 4. The spokes 32 may be relatively thin in horizontal crosssection, and may have a vertical height dimension as disclosed and claimed in the above referenced Wotoweic patent application. The spoke 32', which terminates at a housing 34' surrounding the ends 37 of the circular lamp, may be provided with an enlarged hollow tapered region 38 adjacent to the connector housing 34', to help facilitate accomodation of a glow starter switch 39 and associated capacitor 41.

A slide connector 46 is provided within the spoke 32', and is adapted to slide along the axis of spoke 32' and toward or away from the hub 11. A pair of finger grips 47 extend from opposite sides of the slide connector 46 and through openings 48 in the sides of the spoke 32', so they can be gripped by a person's thumb and finger for manually sliding the connector 46 toward or away from the hub 11. The slide connector 46 and its finger grips 47 can be integrally molded from plastic or rubber. A vertical slot 51 at the inside of the sleeve ring 31 mates with the raised socket 23 of the hub 11, for preventing the lamp assembly 12 from rotating on the hub 11, and for also aligning the lamp assembly spoke 32' with the socket 23 of the hub. A pair of electrical connector prongs 52, 53 extend from the slide connector 46 toward and respectively in alignment with the socket contacts 22 and 24. The slide connector 46 can be manually moved far enough away from the hub 11 so that the tips of the prongs 52 and 53 will not touch or interfere with the sliding insertion of lamp assembly 12 over and around the cylindrical portion 14 of the hub 11, whereupon the slide connector 46 is manually moved toward the hub 11 so that its connector prongs 52 and 53 enter into the hub socket 23 and engage its contacts 22 and 24, respectively. A pair of flexible wires 56, 57 are attached to the connector prongs 52 and 53, respectively, and the other ends of the wires 56 and 57 are respectively connected to lead wires at respective ends 37 of the circular lamp 36, each of these lead wires being respectively connected to the end of a filament in each of the two ends of the lamp 36. These filaments are conventional and are not shown in the drawing. The lamp starting switch 39 is electrically connected to the lamp 36 lead wires 58 and 59 which are respectively connected to the remaining ends of the filaments of the lamp 36. The capacitor 41 is electrically connected across the starting switch 39, to reduce radio interferrence emissions.

Figure 6:
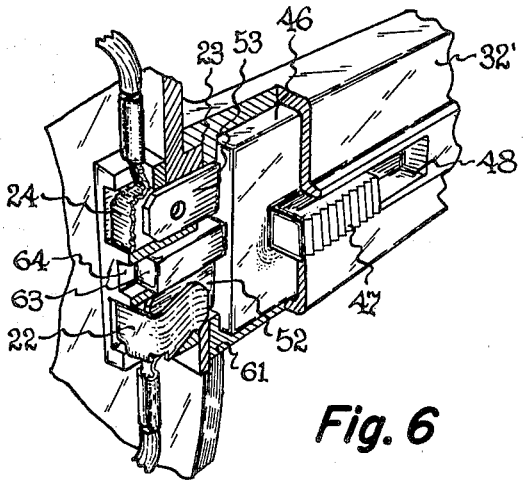

FIG. 5 illustrates the position of the slide connector 46 when it is retracted, for insertion of the circular lamp assembly onto, or removal from, the hub 11. FIG. 6 shows the arrangement of the invention with the slide connector 46 in its operating position, with the electrical prongs 52 and 53 inserted into the socket 23 and in engagement with socket contacts 22 and 24, whereby the hub 11 and lamp assembly 12 provide an integral operational lamp unit. An outwardly extending flange 61 around the bottom portion of the cylindrical hub part 14 facilitates initial positioning of the sleeve ring 32 with respect to the socket 23, for the aforesaid insertion of the connector prong 52 and 53 into the socket, in cooperation with the aforesaid mating of the extended socket 23 and slot 51 in the sleeve ring, for preventing rotational relative motion. The aforesaid positioning of the said lamp assembly on the hub 11 can further be facilitated by providing a sleeve ring slot 51 which extends not quite fully to the upper inner surface of the sleeve ring 31, as illustrated by the numeral 62 in FIG. 3A. The mechanical connection of the lamp assembly 12 to the hub 11 is facilitated by providing a locking prong 63 extending from the slide connector 46 toward the hub 11, and located between the connector prongs 52 and 53; this locking prong mates into a suitable opening 64 in the center region of the socket 23. The locking prong 63 can be molded integrally with slide connector 46.

The lamp unit is easily placed in a socket, by first screwing the base of hub 11 into the socket. This is easily done, because of the compact and circular shape of the hub. Then the lamp assembly 12 is slid over and around the cylindrical portion 14 of the hub, and the slide connector 46 is moved toward the hub to complete the electrical and mechanical connection as described above. To easily remove the lamp unit, the foregoing steps are repeated in reverse order. To replace the lamp assembly, the slide connector 46 is moved away from the hub 11, the lamp assembly is lifted off the hub, and a new lamp assembly is placed on the hub as has been described. To place the lamp unit of the invention in a floor or table lamp having a shade supported by a harp, the shade and harp are removed, and only the hub 11 is easily screwed into the socket, as described above. The circular lamp assembly 12 is then slid over and around the hub and the slide connector 46 is moved toward the hub to complete the connections. The harp is the placed through spaces between spokes 32 and reconnected, and the shade is reconnected to the harp. The overall diameter of the hub 11 and sleeve ring 31 can be made about the same or smaller than that of a conventional incandescent light bulb used in table or floor lamps, and the inner diameter of the circular light bulb 36 is larger than the width of conventional lamp harps.

Figure 7:
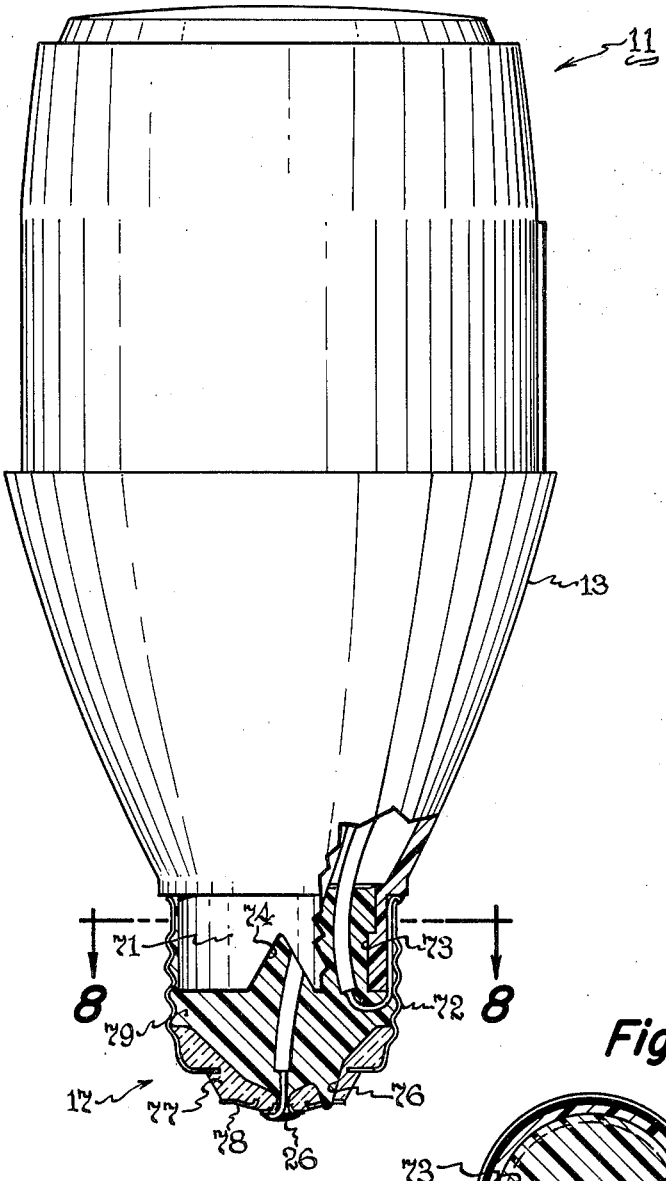
FIG. 7 is a side view of the hub, shown partly broken away to show interior construction of the base and housing end region.
Figure 8:
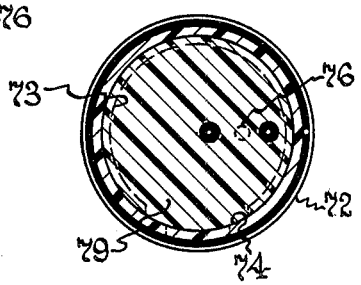
FIG. 8 is a cross-section view taken on the line 8—8 of FIG. 7.

In accordance with the invention, and as shown FIGS. 7 and 8, the lower end region 71 of the hub housing 13 is provided with a cylindrical shape over which a portion of the threaded shell 72 of the base 17 fits. The lower end region 71 is provided with an inwardly extending shelf 73 which may extend continuously or partly, or in spaced-apart sections, around the lower part of the inner surface of the lower end region 71. One or more notches or grooves 74 are provided in the end region 71 at the bottom thereof. An off-center depression or dimple 76 is provided in the insulation material 77 which holds together the threaded shell 72 and the button terminal 26 of the base 17. For convenience and economy, the base 17 may be a three-way light bulb base having a ring terminal 78 intended for connection to a third lead-in wire of a three-way bulb; the depression 76 is provided so that the third wire can be connected to the ring terminal 78. Further in accordance with the invention, the base 17 is mechanically attached and locked to the housing 13 by means of a resin 79 which may be placed into the base 17 in a liquid or paste form. The base is then placed over the lower region 71 of the housing 13, and the resin 79 is cured by heat and/or temperature and/or a catalyst or chemical curing agent until it hardens and solidifies. The base is filled with the resin 79, or sufficient resin is provided, so that the top of the resin extends above the top of the shelf 73, and also the base 17 is positioned around the housing end region 71 so that some of the threads of the threaded shell 72 are exposed to the resin 79. Thus, the base 17 is mechanically locked to the housing 13, as follows. The base cannot be pulled from the housing because the resin 79 overlaps the top edge of the shelf 73 and also internally engages some threads of the base shell 72, thus locking the base to the housing. Also, the base cannot be twisted or rotated with respect to the housing, because the resin 79 projects into the housing notch 74 and into the base dimple 76, thus locking the parts against relative rotation. Instead of providing the housing notch 74, the shelf 73 can be provided with a slot or a projection for locking to the resin, and various notches, dimples, and other contours can be provided on the base and housing to mechanically lock them together by means of the resin 79.

Since, in accordance with the invention and as described above, the base and housing are mechanically locked together by the resin, an adhesive type of resin is not required, and therefore various lower cost and non-adhesive resins can be used, such as polyester resins. Another reason that low-cost resins can be used, is that it does not matter if the resin shrinks a bit during curing; a slightly shrinked resin will lock the base to the housing satisfactorily. The invention obviates the need for using relatively expensive adhesive and non-shrinking resins (an adhesive resin, if it shrinks, will not adhere to the parts satisfactorily).

The invention has been found to achieve its objectives of providing secure and low-cost attachment of a base to a lamp housing, and permits a wide scope of resins to choose from since the resin need not be adhesive and need not be non-shrinkable. The invention is not limited to the particular lamp assembly disclosed herein.

While preferred embodiments of the invention have been shown and described, various other embodiments and modifications thereof will become apparent to persons skilled in the art, and will fall within the scope of the invention as defined in the following claims.

What we claim as new and desire to secure by United States Letters Patent is:

1. A lamp unit comprising a housing and a base positioned over an end of said housing, and means attaching said base and housing together comprising a resin material within said base and said end of the housing, said base and said end of the housing being contoured to engage said resin so that the resin mechanically locks together said base and said housing.

2. A lamp unit as claimed in claim 1, in which said resin is a non-adhesive type.

3. A lamp unit as claimed in claim 1, in which said resin is a type that may shrink during curing.

4. A lamp unit as claimed in claim 1, in which said base and housing end are contoured to engage said resin to prevent the base from being pulled from the housing and are further contoured to prevent the base from twisting with respect to the housing.

5. A lamp unit as claimed in claim 1, in which said end of the housing is provided with an inwardly extending shelf which engages with said resin, and in which said base is provided with screw threads which engage with said resin, thereby preventing the base from being pulled from the housing.

6. A lamp unit as claimed in claim 1 or claim 5, in which said end of the housing is provided with a notch engaged by said resin, and in which said base is provided with an off-center dimple engaged by said resin, thereby preventing the base from twisting with respect to the housing.

* * * * *